US005147173A

United States Patent [19]

Fauber et al.

[11] Patent Number: 5,147,173

[45] Date of Patent: Sep. 15, 1992

[54] COUPLING DEVICE

[75] Inventors: Raymond L. Fauber; Richard A. Fauber, both of Bartonville; Ronald E. Fauber, East Peoria, all of Ill.

[73] Assignee: Caterpillar Inc., Peoria, Ill.

[21] Appl. No.: 709,452

[22] Filed: Jun. 3, 1991

[51] Int. Cl.[5] ..... E02F 3/96

[52] U.S. Cl. ..... 414/723; 403/322; 403/325; 172/273

[58] Field of Search ..... 414/723, 912; 172/272-274; 37/231, 236, DIG. 3, DIG. 12, 117.5; 403/31, 322, 325

[56] References Cited

U.S. PATENT DOCUMENTS

| | | | |
|---|---|---|---|
| 3,243,066 | 3/1966 | Gardner et al. | 414/723 X |
| 4,214,840 | 7/1980 | Beales | 414/723 X |
| 4,242,034 | 12/1980 | Schmitz | 414/723 X |
| 4,632,595 | 12/1986 | Schaeff | 414/723 X |
| 4,850,790 | 7/1989 | Johnson et al. | 414/723 |
| 4,854,813 | 8/1989 | Degetter et al. | 414/723 |
| 5,010,962 | 4/1991 | Bloom, Jr. | 414/723 X |
| 5,082,389 | 1/1992 | Balemi | 403/322 |

FOREIGN PATENT DOCUMENTS

| | | | |
|---|---|---|---|
| 389906B | 2/1990 | Austria . | |
| 0143074 | 9/1984 | European Pat. Off. . | |
| 0273828A1 | 7/1988 | European Pat. Off. . | |
| 0409796 | 1/1991 | European Pat. Off. | 172/272 |
| 0065639 | 5/1980 | Japan | 414/723 |
| WO8303629 | 10/1983 | PCT Int'l Appl. . | |
| WO8900632 | 1/1989 | PCT Int'l Appl. . | |
| 1021722 | 6/1983 | U.S.S.R. | 414/723 |
| 1247470 | 7/1986 | U.S.S.R. | 414/723 |
| 2208220A | 3/1989 | United Kingdom . | |

*Primary Examiner*—Robert J. Spar
*Assistant Examiner*—William M. Hienz
*Attorney, Agent, or Firm*—William C. Perry

[57] ABSTRACT

Earthmoving vehicles are often provided with quick coupling devices that allow them to change work implements in a relatively rapid fashion when compared to changing conventionally mounted implements. In most cases, the performance of the work implement is sacrificed to accommodate the ability to change implements quickly. In other cases the level performance is satisfactorily maintained, but the actuation of the coupling mechanism must be done manually or has no ability to accommodate loosening between the coupler and the work implement that can result from normal operation. The coupling device of the present invention allows an operator to change implements from his position within his operating station, yet maintain a structure that will not sacrifice the performance of his work implements through alteration of the linkage arrangement or through the additional weight. The locking means between the coupler and the implement are positioned for the optimum transferal of force between the components and includes a means which will continually take up any loosening that may occur through wear or operational loading.

20 Claims, 3 Drawing Sheets

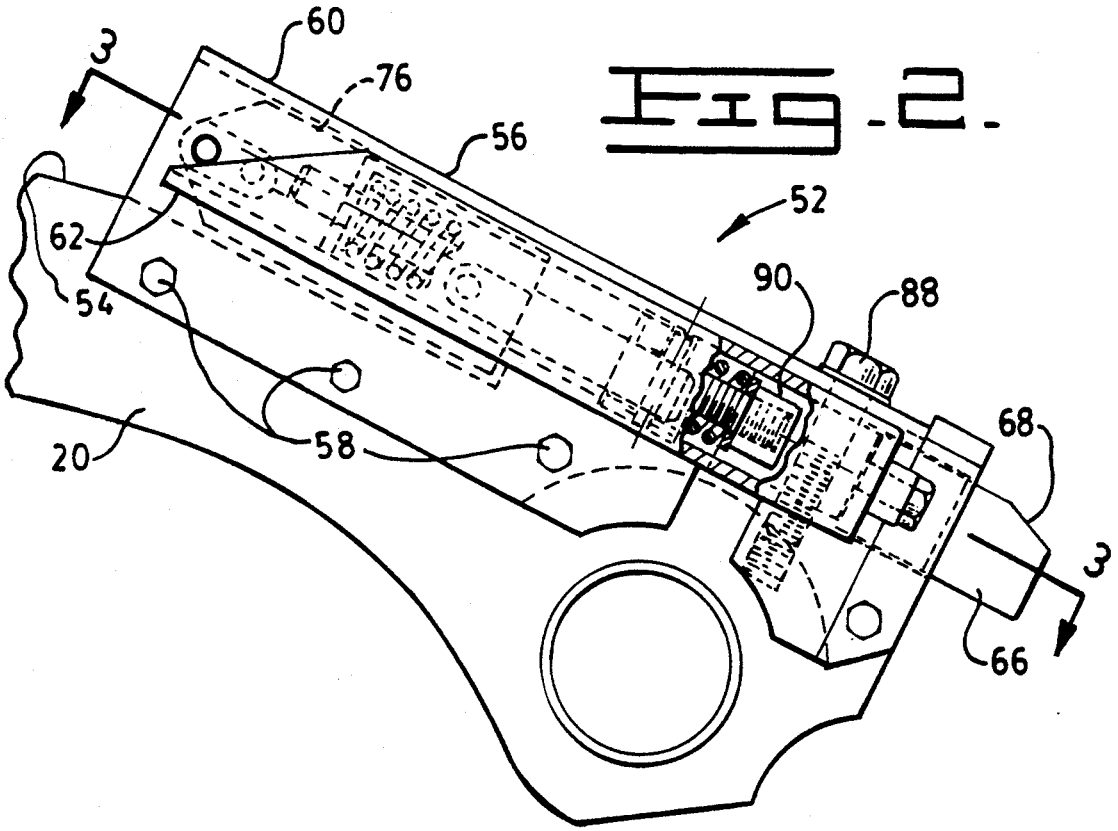
Fig. 2.
Fig. 3.
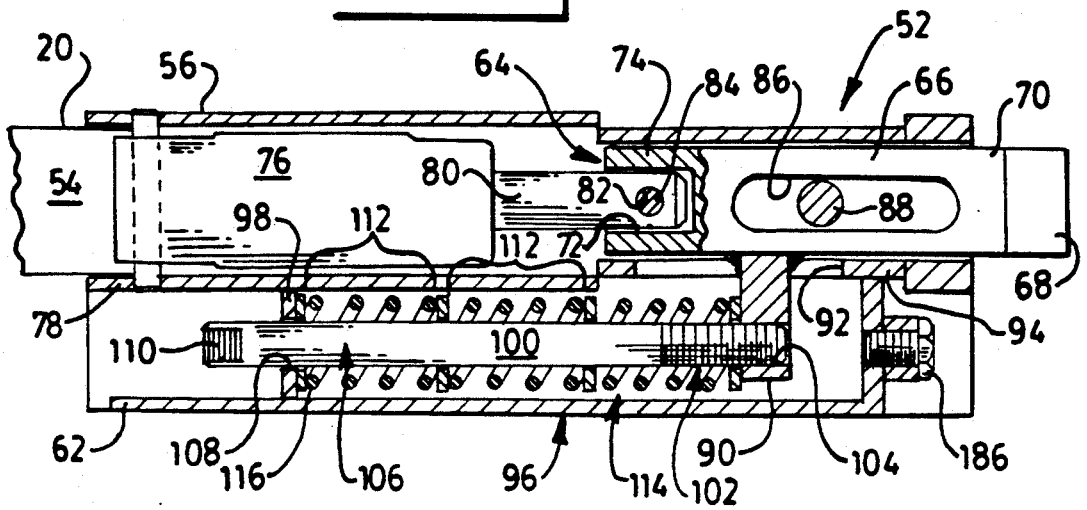

COUPLING DEVICE

DESCRIPTION

1. Technical Field

This invention relates to a coupling device and more particularly to a coupling device between a linkage arrangement supported by a work vehicle and a variety of work implements to which the linkage arrangements may be quickly attached and detached.

2. Background Art

In the operation of construction equipment in recent years there has been a growing trend to utilize machines originally intended for a rather specific task in much more varied applications. In order to accomplish this, coupling mechanisms have been developed to allow a vehicle to mount and utilize more than one implement For example, in the operation of a hydraulic excavator, an operator may encounter various types of soil on a single job site. When this happens, it is often necessary to change from one bucket to another or in situations wherein rocky conditions are encountered an entirely different implement, such as a powered hammer, may be required. In each of these situations, it is desirable to be able to quickly detach one tool and attach the next tool.

Several different types of quick coupling mechanisms have been utilized with varying degrees of success. One design that has achieved a great deal of success over the last few years is disclosed in U.S. Pat. No. 4,854,813, issued to Robert L. Degeeter et al. on Aug. 8, 1989. This design utilizes a pair of connecting links that are mounted to the linkage of an excavator by a pair of pins that would normally mount a bucket. The connecting links are received by a work implement having a pair of hinge plates that have been configured such that the pin location of the connecting links will be located at the same location of the pins of a conventionally mounted bucket. In doing so, the tipping radius of the implement is not altered from that of a conventional bucket, thus the hydraulic power available to the implement in operation is not changed. Also, the weight of this coupling device approximately equals that of a conventional bucket and therefor the bucket capacity is not sacrificed.

The connecting links are mounted to the bucket by a pair of wedge members that are bolted to the connecting links and may be moved into and out of engagement with the hinge plates of the bucket to connect and disconnect the bucket from the linkage arrangement. With the bucket and connecting links in appropriate alignment for connection, the wedges are moved into or out of contact with the hinge plates manually by the force provided by a hammer wielded by the operator or other service personnel. When in place, the mounting bolts are tightened to secure the wedges in place and the bucket is ready for operation.

While this system has worked quite well, especially since the mounting means maintains all the operating forces in a generally linear plane, room for improvement has been identified. One such area of improvement resides in the fact that manual engagement and disengagement is required. Another resides in the lack of a continual force in the direction of wedge engagement to maintain an absolutely solid connection between the linkage and the bucket. While proper measures are available to prevent the unexpected uncoupling of the bucket from the linkage arrangements, there are certain conditions that may cause the connection to loosen slightly and permit the bucket to move with respect to the linkage during operation. This is not only aggravating to an operator, but it also accelerates the wear of the various components.

The present invention is directed to overcoming one or more of the problems set forth above.

DISCLOSURE OF THE INVENTION

In one aspect of the present invention, a coupling device for securing a linkage arrangement having at least one connecting link to a work implement having at least one mounting plate is disclosed. The two components are arranged with the connecting link being in linear alignment with respect to the mounting plate. The coupling device includes a means for locking the connecting link to the mounting plate. The locking means is secured to the connecting link in a manner to position it in linear alignment with both the connecting link and the mounting plate. The locking means includes a fluid actuator that selectively moves between a first position wherein the locking means is disengaged from the mounting plate, and a second position wherein the locking means is engaged with the mounting plate. Also included is a means for biasing the locking means toward its second position. The biasing means is attached to the locking means in such a manner that the biasing means is located substantially on the same lateral plane as the locking means and slightly offset from alignment with the connecting link and the mounting plate.

Another aspect of the present invention comprehends a coupling device for a linkage arrangement having a pair of connecting links that are adapted to engage a pair of mounting plates defined by a work implement in overlying, linear relation to each other. A locking member is mounted on each connecting link in linear alignment with the respective aligned connecting link and mounting plate. The locking member is moveable with respect to these components between a first position wherein the locking member is removed from engagement with the respective mounting plates, and a second position wherein it is engaged with the respective mounting plates. A fluid actuator is mounted on each connecting link in overlying, linear alignment with the respective aligned connecting links and mounting plates. A means for providing fluid under pressure to the fluid actuator is included to permit the selective movement of the locking member between its first and second positions. A means for biasing the locking member toward its second position is also provided. The biasing means is operatively engaged with the locking member and is positioned laterally adjacent the locking member and the fluid actuator. A means for manually disengaging the locking member from contact with the respective mounting plate is included and is engageable with the locking member in a manner that is in direct opposition to the biasing means to move the locking member toward its first position. A means for indicating the position of the locking member is provided and is operatively connected to the locking member so as to move with it.

Yet another aspect of the present invention includes a coupling device for securing a linkage arrangement having at least one connecting link to a work implement having at least one mounting plate. A locking member is mounted to the connecting link and is moveable between a first position, wherein the locking member and the connecting link are moveable relative to the work implement and a second position wherein the locking member is engaged with the mounting plate of the work implement to couple the connecting link and the work implement. A fluid actuator is operatively connected to the connecting link and the locking member to provide movement of the locking member between its first and second positions. A means for providing pressurized fluid to the fluid actuator is included and is operable in a first condition wherein the fluid is directed to the fluid actuator at a first actuating pressure to selectively move the locking member between its first and second positions, and a second condition wherein the fluid is directed to the fluid actuator at a second, maintaining pressure to continually urge the locking member only toward its second position.

The coupling device as set forth above, allows the operator of construction vehicle to detach one work implement and quickly attach a second work implement to the operational linkage of the vehicle as he remains in position within his operating station. In addition to dramatically reducing the actual time required to complete the change in implements, a linear relation of the components and thus an optimum path of force transmission is maintained. Also, in addition to the major improvement in cycle time required to change implements, the incorporation of the fluid actuator within the coupling design allows the design to take advantage of additional capabilities. One example resides in the capability of the system to utilize a first, relatively high pressure for ease and speed during the engagement and disengagement of the locking member with the work implement and a second relatively low pressure, commensurate with the pilot pressure of the vehicle, to maintain force behind the locking member to keep the connection tight as the implement is subjected to working forces. Further, a spring backup is provided to apply this force to urge the locking member toward its engaged position should there be an absence of communication of pressurized fluid to the fluid actuator.

It can therefor be seen that a coupling device of this type allows for an extremely quick transition between implement changes while incorporating optimum use of force transmitting during implement operation to maintain the clamping integrity of the coupling.

BRIEF DESCRIPTION OF THE DRAWINGS

FIG. 2 is an enlarged elevational side view of the coupling device as seen in FIG. 1;

FIG. 3 is a top view of the coupling device taken along lines 3—3 in FIG. 1;

BEST MODE FOR CARRYING OUT THE INVENTION

Figure 1:
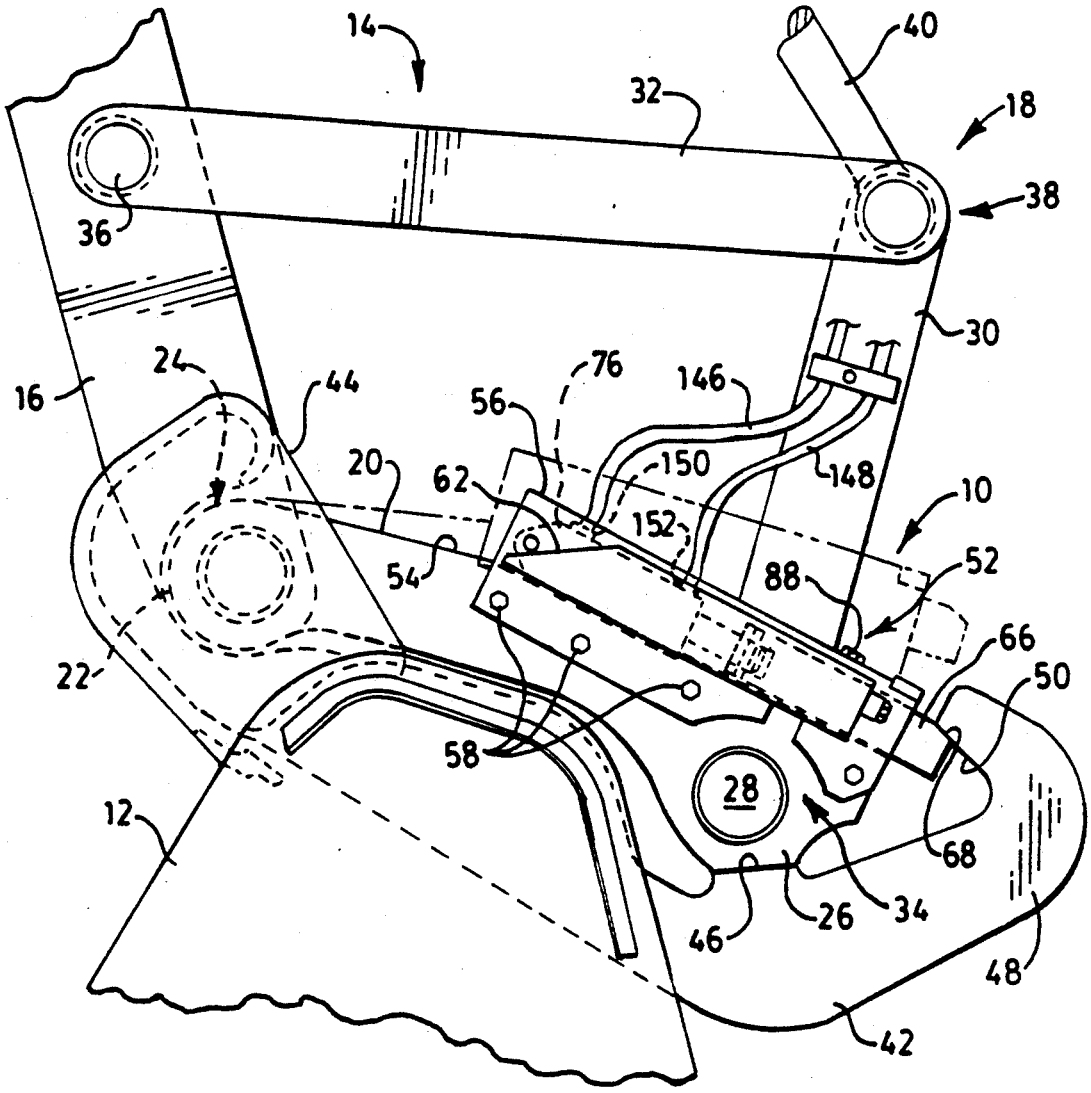
FIG. 1 is a partial side elevational view of a linkage arrangement and a work implement that are mounted to one another by a coupling device that embodies the principles of the present invention.

Referring now to the drawings, and more particularly to FIG. 1, a coupling device 10 is shown that connects a work implement 12 to a linkage arrangement 14 of a vehicle (not shown). While it is to be understood that this device could be shown for use on a number of different vehicles for illustration purposes, it is disclosed and described herein as being associated with a linkage arrangement commonly utilized by hydraulic excavators for which its use is well suited.

The linkage arrangement 14 includes a main support arm, or stick 16, with which the work implement 12 is pivotally oriented and a rotation linkage 18 that is utilized to pivot the work implement 12 with respect to the main support member 16. Mounted between the stick 16 and the rotation linkage 18 is a pair of elongated connecting links 20. Since only one side of the linkage arrangement, work implement, and associated components is disclosed, it is to be understood that the components on each side of the centerline of the work implement are identical and therefor only one side will be hereinafter described with identical reference numerals being applicable to identical components. The connecting links 20 have a first end portion 22 that is pivotally mounted to the support arm 16 by a mounting pin 24. Likewise, a second end portion 26 of the connecting links 20 is pivotally connected to the rotation linkage 18, which will be described in greater detail hereinafter, by a mounting pin 28. The rotation linkage 18 consists of a pair of first and second links 30 and 32 that are respectively known as the power and idler links. The first and second pairs of links 30 and 32 extend from respective pivotal mountings 34 and 36 with the second end portion 26 of the connecting links 20 and the stick member 16 to a point 38 at which the first and second pairs of links 30 and 32 are pivotally joined together. Also included in the pivotal connection shown at 38 is the distal end 40 of a hydraulic cylinder (not shown) whose reciprocation causes the pivoting of the rotation linkage 14 about the mounting 36 of the idler n the transfer of this motion through the power links 30 to the second end 26 of the connecting links 20 to pivot the connecting links 20 about their mounting 24 with the stick 16.

Each connecting link 20 is engaged with a mounting plate or hinge plate 42 that extends from the work implement 12 for purposes of attachment. The mounting plates 42 each have a first mounting portion 44 that acts as a receptacle to receive the first end portion 22 of the connecting links 20, and a second mounting portion 46 that receives the second end portion 26 of the connecting links 20. An upwardly extending flange 48 is formed by the second mounting portion 46 of each hinge plate 42 and further defines an angled surface 50 that is located in close proximity to the second end portion 26 of each connecting link 20. The connecting links 20 and the hinge plates 42 are aligned in overlying, linear relation to one another so that forces which result from operation of the work implement will be directly transferred from one component to the other in optimum fashion.

Figure 4:
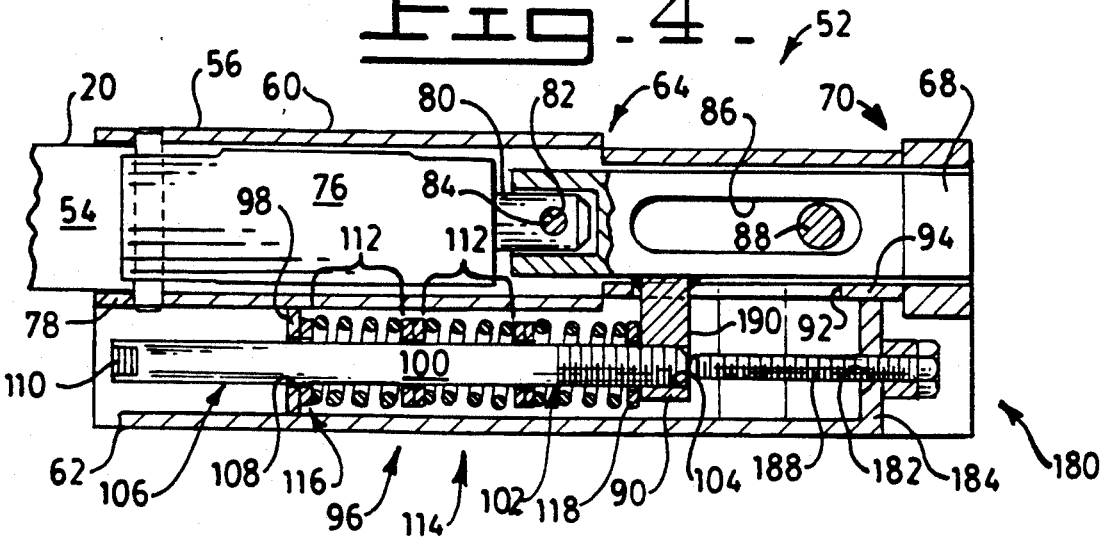
FIG. 4 is a view similar to FIG. 3 with the locking means repositioned toward its uncoupled position.

A coupling device generally indicated at 52 is mounted to an upper surface 54 of each connecting link 20 in the region of the second end portion 26 thereof. The coupling device 52 forms a housing 56 that is secured to the connecting links 20 by a plurality of bolts 58. Referring primarily to FIGS. 3 and 4, it can be seen that the housing 56 defines a first portion 60 that is positioned directly over the connecting link 20 and a second housing portion 62 that is laterally offset therefrom. Within the first housing portion 60 a locking means 64 is slidably positioned. The locking means 64 further includes a locking member or wedge member 66 that defines an angular surface 68 on a first end portion 70 thereof, and a bore 72 on a second end portion 74 thereof. A fluid actuator 76 in the form of a hydraulic cylinder is positioned between a rear portion 78 of the first housing portion 60 and the second end portion 74 (FIG. 2) of the wedge member 66. A rod portion 80 extends from the hydraulic cylinder 76 and defines a bore 82 that is alignable with the bore 74 in the second end portion 74 of the wedge member 66 to receive a mounting pin 84 that connects the wedge member 66 to the hydraulic cylinder 76 for reciprocating movement with respect to the first housing portion 60 between a first position wherein the wedge member 66 is held in a position totally within the first housing portion (FIG. 4) and a second position wherein the angular surface 68 of the wedge member is engaged with the angular surface 50 of the mounting plate 42. As can be seen in FIG. 3, an elongated slot 86 is vertically positioned within the wedge member 66 to receive a bolt 88 that extends from the first housing portion 60 into the connecting link 20. The bolt serves as a guide for the wedge member 66 as it moves with respect to the first housing portion 60 to prevent it from jamming. The wedge member 66 further defines a flange 90 that extends laterally therefrom into the second housing portion 62 through an opening 92 in a common wall 94 that extends between the two housing portions 60 and 62.

Positioned within the second housing portion is a biasing means 96. The biasing means 96 is positioned between a rearward wall 98 of the second housing portion 62 and the flange 90 that extends from the wedge member 66 to urge the wedge member toward its second position. The biasing member 96 includes a rod member 100 that has a first threaded end portion 102 that is threadably engaged with a threaded bore 104 that extends through the flange 90 of the wedge member 66. A second end portion 106 of the rod member 100 extends through an aperture 108 in the rear wall 98 of the second housing portion 62 and moves freely with respect thereto into and out of the second housing portion. A highly visible form of indicia indicated at 110 in FIG. 3 is formed on the second end portion 106 of rod 100 to indicate the position of the rod member with respect to the rear wall 98. A plurality of spring segments 112 are positioned in end-to-end relation with one another about the rod 100. The spring segments 112 collectively form a spring column 114 that has a first end 116 that engages the rear wall 98 of the second housing portion 62 and a second end 118 that engages the flange 90 of the wedge member 66.

Figure 5:
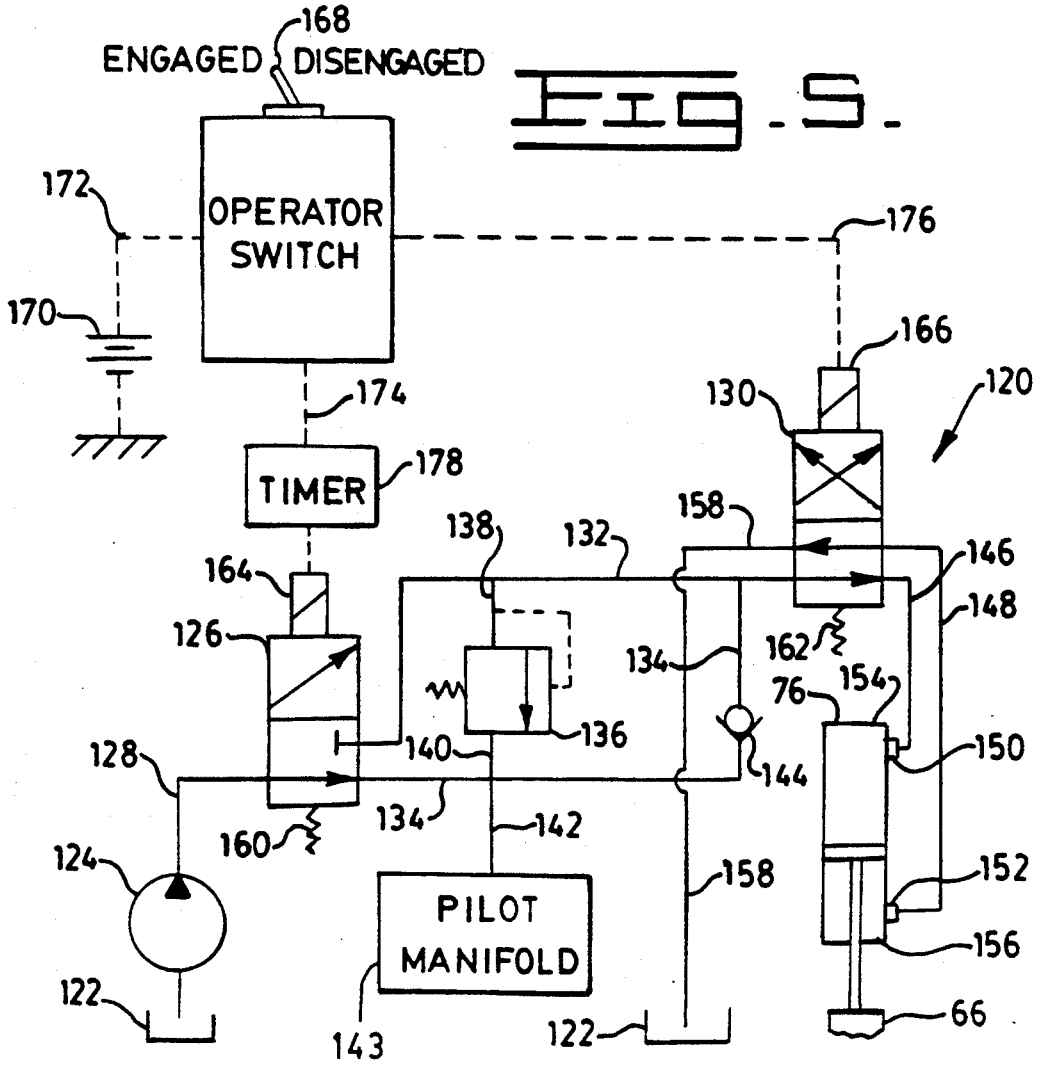
FIG. 5 is a schematic diagram of the hydraulic circuity utilized in the operation of the present invention.

Turning now to FIG. 5, a means 120 for supplying fluid pressure of the hydraulic cylinder 76 is illustrated in the form of a schematic hydraulic circuit. The hydraulic system is operated from the pilot system available to the operator to operate the various machine functions. Pressurized fluid is provided from a reservoir or tank 122 by a pump 124 to a first selector valve 126 via conduit 128. The selector valve 126 is a two position valve, which during normal operation of the implements is supplied with pressurized fluid at a normal pilot pressure of approximately 400 psi (2760 kPa). The selector valve 126 is in fluid communication with a two position directional valve 130 via conduit 132. Another conduit 134 extends from the selector valve 126 and communicates with conduit 132. A pressure relief valve 136 having a maximum pressure of approximately 1500 psi (10,340 kPa) is positioned between conduits 132 and 134 and is in communication therewith via conduits 138 and 140. Another conduit 142 interconnects the conduits 134,140 and the pressure relief valve 136 with a pilot manifold 143 to insure that fluid flow from the pump 124 is maintained for the operation of other vehicle implements. A one-way check valve 144 is positioned in conduit 134 to prevent the fluid flow between conduit 132 and 134 from bypassing the pressure relief valve 136. A pair of conduits 146 and 148 extend from the two position directional valve 130 to inlets 150 and 152 positioned on a respective head and rod ends 154 and 156 of the hydraulic cylinder 76. A third conduit 158 extends from the directional valve 130 and communicates the fluid from valve 130 to the tank 122.

Both valves 126 and 130 are biased to a first position as shown in FIG. 5, by a spring 160 and 162 respectively. In order to move the valves to their second position, electrically actuated solenoids 164 and 166 are respectively positioned on valves 126 and 130 to oppose the bias of springs 160 and 162 to move the valves to the second position upon actuation of the solenoids. Actuation of the solenoids 164 and 166 is controlled by a two position switch 168 that is located in the operator's station and selectively actuated by an operator Current to the switch 168 is provided from a battery 170 via wire 172. The switch is in turn connected to the solenoids 164 and 166 via wires 174 and 176 respectively. A timer 178 is connected by wire 174 to the switch 168 and the solenoid 164 to allow the current to flow through wire 174 for only a specified amount of time before the solenoid 164 is deactivated and the valve 126 is returned to its first position.

A manually operated disengagement means 180 is included in the design of the coupling device and is best illustrated in FIG. 4. As can be seen, a threaded aperture 182 is formed in a forward wall 184 of the second housing portion 62. The threaded aperture 182 is normally closed by a cap member 186 shown best in FIG. 3. Upon removal of the cap member 186 an elongated threaded member 188, such as a bolt, may be inserted into the threaded aperture 182 and, upon rotation thereof, is engageable with a forward face 190 of the flange 90. The bolt 188 serves to act against the bias of the spring column 114 to move the wedge member 66 to its first position.

Industrial Applicability

As an operator of a vehicle is manipulating a work implement 12 of a vehicle in normal fashion, the condition of the hydraulic circuit is that which is illustrated in FIG. 5 of the drawings. In this condition, pressurized fluid is directed to the selector valve 126 via conduit 128 by pilot pump 124. Since the switch 168 has not been activated at this point, the selector valve 126 is held in the position shown by spring 160. In this position, fluid is allowed to pass through the valve to conduit 134 and is in turn directed through the check valve 144 to conduit 132. Since communication of fluid back through the selector valve 126 through conduit 132 is blocked, the fluid is communicated through the directional valve 130, and on to inlet 150 of the hydraulic cylinder 76 via line 146. In this condition, the fluid is directed to the head end 154 of the hydraulic cylinder at pilot pressure which is approximately 400 psi (2260 kPa) to maintain a constant force urging the piston rod 80 in an outward direction. Since the wedge member 66 is directly connected to the piston rod, the fluid pressure is translated into a force that continually urges the angled surface 68 and 50 of the respective wedge member 66 and mounting plate 42 into engagement to 1 insure a solid connection at all times during operation of the implement 12.

If at some point during the manipulation of for a variety of other reasons, the operator may very well decide that a different work implement is required. In order to change implements the operator initiates the change with the actuation of the electrical switch 168 which will be conveniently positioned on or near one of his control levers. As he moves the switch 168 to a first "disengage" position, electric current is directed simultaneously through wires 174 and 176. As the current flows through wire 174 it energizes the timer 178 which in turn allows the current to continue on to solenoid 164. Upon actuation of the solenoid 164, the selector valve 126 is moved to its second position for the specified period of time which is approximately between 10–15 seconds. Likewise, current supplied via wire 176 to solenoid 166 causes the directional valve 130 to shift to its second position In this condition, fluid from the pump 124 is communicated to the selector valve 126 via conduit 128. The fluid is then directed through the selector valve to conduit 132. The fluid is then communicated to the pressure relief valve 136 via conduit 138 which in turn communicates the fluid to the directional valve 130 via conduit 134 at an increased pressure of approximately 1500 psi (10,340 kPa). The fluid is then directed through the directional valve 130 to conduit 148 which in turn communicates the fluid to the inlet 152 at the rod end 156 of the hydraulic cylinder 76. The head end 154 of the hydraulic cylinder 76 is simultaneously communicated with the reservoir 122 via conduit 158. This increased fluid pressure applies a disengaging force to separate the two angled surfaces 68 and 50 which after several hours of operation tend to seat very tightly together. After the specified period of time has elapsed, the timer 178 interrupts the flow of electricity to the solenoid 164 and the valve 126 returns to its first position under the bias of spring 160.

After the hydraulic cylinder 76 and the wedge 66 have been retracted, the operator may then manipulate the linkage arrangement 14 to remove it from contact with that particular work implement 12 and re-engage another. After seating the connecting links 20 in proper position with respect to the mounting plates 42 of the next work implement 12, the operator may then move the switch 168 back to its first, or "engage" position. Movement of the switch 168 will automatically cause reactivation of the timer 178 to re-energize the solenoid 164 and shift the selector valve 126 back to its second position At the same time, the solenoid 166 of the directional valve 130 is de-energized to allow it to shift back to its first position as shown in FIG. 5. In this condition, the fluid pressure is again communicated to the directional valve 130 via conduit 132, the pressure relief valve 136 and conduit 134 to raise the pressure of the fluid to the increased rate. With the directional control valve being shifted back to its first position, the fluid is directed via conduit 146 to the inlet 150 at the lead end 154 of the hydraulic cylinder 76 to cause engagement of the wedge member 66. As this occurs, the fluid in the rod end 156 of the cylinder 76 is directed to the reservoir 122 via conduit 158. As the allotted time elapses, the timer 178 interrupts current flow to the solenoid 164 of the selector valve 126 and the rate of pressure directed throughout the circuit again drops to pilot pressure to maintain a constant engagement force urging the wedge member 66 towards its second engaged position.

In the unlikely event that the vehicle would lose power or the fluid flow would otherwise be interrupted, the biasing means 96 provides a back-up force to the wedge member 66 to insure its connection with the mounting plates 42 of the work implement 12. If a need should arise to remove the work implement 12 without the availability of pressurized fluid, the manual disengagement means 180 may be utilized to move the wedge member 66 to its first position. To utilize the disengagement means 180 the elongated bolt 188 is inserted into the threaded aperture 182 positioned in the forward wall 184 of the second housing portion 62. As the bolt is rotated in a clockwise direction, it is advanced into the second housing portion 62 until it engages the forward facing surface 190 of the flange 48. Further advancement of the bolt 188 will result in the movement of the wedge member 66 to its first position. This allows the work implement to be manually released to facilitate movement or service of the vehicle as for use of the work implement on another vehicle.

Other aspect, objects and advantages of this invention can be obtained from a study of the drawings, the disclosure and the appended claims.

We claim:

1. A coupling device for securing a linkage arrangement having a pair of connecting links to a work implement having a pair of mounting plates, with the connecting links positioned in linear alignment with respect to the mounting plates, comprising:

means for locking the respective connecting links to the mounting plates, said locking means being secured to each of the respective connecting links in a manner to position it in linear alignment with the respective connecting links and the mounting plates;

a pair of fluid actuators, each actuator mounted on a respective connecting link in overlying, linear alignment with respect thereto and being connected to the locking means to selectively move the locking means between a first position wherein the locking means is disengaged from the mounting plates and a second position wherein the locking means is engaged with the mounting plates; and means for biasing the locking means toward its second position, said biasing means being attached to the respective locking means associated with each connecting link in such a manner that the biasing means is located substantially on the same lateral plane as the locking means and slightly offset from the respective actuator and from alignment with the respective connecting link and mounting plate.

2. The coupling device as set forth in claim 1 wherein the mounting plates each define an angled surface.

3. The coupling device as set forth in claim 2 wherein the locking means further defines a pair of wedge members each having an angled surface formed thereon, the wedge members being associated with the connecting links so that the angled surface of each wedge member is engageable with the angled surface of the respective mounting plate when the locking means is in its second position.

4. The coupling device as set forth in claim 1 wherein a means for selectively moving the locking means from its engaged position with respect to the respective mounting plate, is operatively associated with the biasing means said moving means being engageable with the biasing means to move the biasing means and the locking means toward the first position thereof.

5. The coupling device as set forth in claim 1 wherein a means for indicating the position of the locking means is operatively associated therewith.

6. The coupling device as set forth in claim 1 wherein a respective first housing portion is mounted on an upper surface of each connecting link and encapsulates the locking means, and a respective second housing portion extends laterally from the first housing portion and encapsulates the biasing means.

7. The coupling device as set forth in claim 6 wherein the biasing means further includes a plurality of spring segments that are positioned within each second housing portion in end-to-end engagement between a rear wall of the second housing portion and a flange member that is operatively associated with the locking means that extends from the first housing portion into the second housing portion through an opening formed therebetween.

8. A coupling device for a linkage arrangement having a pair of connecting links that are adapted to engage a pair of mounting plates defined by a work implement in overlying, linear relation thereto, comprising: a pair of locking members, each locking member mounted on a respective connecting link in linear alignment with the respective connecting link and mounting plate and being moveable with respect thereto between a first position wherein each locking member is removed from engagement with the respective mounting plate and a second position wherein each locking member is engaged with the respective mounting plate;

a pair of fluid actuators, each actuator mounted on the respective connecting link in overlying, linear alignment with the respective connecting link and mounting plate;

means for providing fluid under pressure to each of the fluid actuators to permit the selective movement of each locking member between its first and second positions;

means for biasing the respective locking members toward their second position, each of said biasing means being operatively engaged with its respective locking member and being positioned laterally adjacent its respective locking member and fluid actuator;

means for manually disengaging the respective locking members from contact with the respective mounting plates, said disengaging means being engageable with the locking members in a manner that is in direct opposition to the biasing means to move each locking member towards its first position; and means for indicating the position of the locking members, said indicating means being operatively connected to the locking members for movement therewith.

9. The coupling device as set forth in claim 8 that further includes:

a respective first housing portion that is mounted to an upper surface of each connecting link and is adapted to receive the respective locking member and fluid actuator therewithin; and a respective second housing portion that is mounted to the respective first housing portion in laterally adjacent relation thereto in a manner to receive the respective biasing means therein.

10. The coupling device as set forth in claim 9 wherein each locking member defines an angled engagement surface and a laterally extending flange, said flange being positioned to extend through an opening between the respective first and second housing portions for engagement with the respective biasing means.

11. The coupling device as set forth in claim 10 wherein each biasing means further includes:

a rod member having a first end portion engaged with the flange defined by the respective locking member and a second end portion that extends through an aperture in a rear wall of the respective second housing portion;

a plurality of spring segments that are positioned about the rod member in end-to-end engagement with one another and extend between the rear wall of the respective second housing portion and the flange of the respective locking member to bias the respective locking member towards its second position.

12. The coupling device as set forth in claim 10 wherein the disengaging means includes a pair of threaded members, each threaded member being engageable with a threaded aperture formed in a front wall of the respective second housing portion, said threaded aperture being aligned with the flange of the respective locking member so that the threaded member will contact the flange upon rotation thereof and thus cause the movement of the respective locking member toward its first position.

13. The coupling device as set forth in claim 11 wherein the indicating means includes a highly visible means of indicia that is applied to the second end portion of the respective rod members and is moveable with the respective rod members and the respective locking members relative to the respective second housing portions to indicate the travel of the respective rod members and thus the movement of the respective locking members between their first and second positions.

14. The coupling device as set forth in claim 8 wherein the means for providing fluid under pressure to the fluid actuators is selectively operable between a first condition wherein fluid is directed to the fluid actuators at a first actuating pressure to selectively move the locking members between their first and second positions, and a second condition wherein the pressurized fluid is directed to the fluid actuators at a second, maintaining pressure to urge the locking members continually toward their second position.

15. A coupling device for securing a linkage arrangement having a pair of connecting links to a work implement having a pair of mounting plates, comprising:

a pair of locking members, each locking member mounted on a respective connecting link in linear alignment with the respective connecting link and mounting plate and being moveable between a first position wherein the locking members and connecting links are moveable relative to the work implement and a second position wherein the locking members are engaged with the mounting plates of the work implement to couple the connecting links thereto;

a pair of fluid actuators, each actuator mounted on the respective connecting link in overlying, linear alignment with the respective connecting link and mounting plate to provide movement of the locking members between their first and second positions;

means for biasing the locking members toward their second position, said biasing means being attached to the respective locking members associated with the respective connecting links in such a manner that the biasing means is located substantially on the same lateral plane as the locking members and slightly offset from alignment with the respective connecting links and the mounting plates;

means for providing pressurized fluid to each of the fluid actuators in a first condition wherein the fluid is directed to the fluid actuators at a first, actuating pressure to selectively move the locking members between their first and second positions, and a second condition wherein the fluid is directed to the fluid actuators at a second, maintaining pressure to continually urge the locking members continually toward their second position.

16. The coupling device as set forth in claim 15. wherein housings are provided to mount the respective locking members and the fluid actuators to the respective connecting links in a manner wherein the locking members are linearly aligned with both the respective connecting links and the respective mounting plates of the work implement in a generally vertical plane.

17. The coupling device as set forth in claim 16 wherein the biasing means extends between the housing and a flange on the respective locking members to urge each locking member toward its second position.

18. The coupling device as set forth in claim 16 wherein a means for disengaging the respective locking members from engagement with the respective mounting plates of the work implement is provided in absence of communication of pressurized fluid to the fluid actuators.

19. The coupling device as set forth in claim 18 wherein the respective disengaging means and biasing means are positioned within the respective housings, the housings being secured to each of the respective connecting links at a position that is laterally adjacent the vertical plane along which the respective connecting links and mounting plates are aligned, and selectively act upon the locking members in opposite directions.

20. The coupling device as set forth in claim 15 wherein the actuating pressure is approximately 10,340 (kPa) the maintaining pressure is approximately 2,760 (kPa).

* * * * *